United States Patent [19]

Fumiyuki et al.

[11] Patent Number: 4,689,283

[45] Date of Patent: Aug. 25, 1987

[54] AMORPHOUS SILICON PHOTORECEPTOR FOR ELECTROPHOTOGRAPHY WITH AL-MN ALLOY BASE

[75] Inventors: Suda Fumiyuki, Yokohama; Hokoda Kazuaki, Kawasaki, both of Japan

[73] Assignee: Stanley Electric Co., Ltd., Japan

[21] Appl. No.: 815,775

[22] Filed: Jan. 2, 1986

[30] Foreign Application Priority Data

Jul. 27, 1983 [JP] Japan ..... 58-135957

[51] Int. Cl.[4] ..... G03G 5/082; G03G 5/10

[52] U.S. Cl. ..... 430/69; 430/127; 420/434; 420/528

[58] Field of Search ..... 430/69, 127; 420/434, 420/528

[56] References Cited

U.S. PATENT DOCUMENTS

| | | | |
|---|---|---|---|
| 4,134,763 | 1/1979 | Fujimura et al. | 430/69 |
| 4,265,991 | 5/1981 | Hirai et al. | 430/65 X |
| 4,405,703 | 9/1983 | Onuma et al. | 430/69 |

FOREIGN PATENT DOCUMENTS

| | | | |
|---|---|---|---|
| 2338520 | 2/1975 | Fed. Rep. of Germany | 430/69 |
| 53-13423 | 2/1978 | Japan | 430/69 |

*Primary Examiner*—Roland E. Martin

*Attorney, Agent, or Firm*—Spensley Horn Jubas & Lubitz

[57] ABSTRACT

An amorphous silicon photoreceptor for electrophotography which provides a very clear image is obtained by forming its electroconductive substrate with an aluminum-manganese alloy.

2 Claims, 2 Drawing Figures

AMORPHOUS SILICON PHOTORECEPTOR FOR ELECTROPHOTOGRAPHY WITH AL-MN ALLOY BASE

This is a continuation of application Ser. No. 634,625 filed Jul. 26, 1984 now abandoned.

BACKGROUND OF THE INVENTION (a) Field of the Invention:

The present invention concerns an improvement in photoconductive photoreceptots used in, for example, electrophotography, and more particularly it relates to an improvement in photoreceptive materials consisting mainly of amorphous silicon.

(b) Description of the prior art:

In the past, as the photoconductive photoreceptive materials employed in, for example, electrophotographic printers and laser printers, there have been used, in general, such substances as selenium (Se), cadmium sulfide (CdS), zinc oxide (ZnO) and organic photoconductive materials. Recently, there has been developed a method of using in place of those materials mentioned above, amorphous (noncrystalline) silicon (hereinafter referred to as a-Si). With respect to the basic composition of a-Si, there is made a detailed description thereof in U.S. patent application Ser. No. 342,650 now U.S. Pat. No. 4,532,196, and its manufacturing conditions are described in detail in U.S. patent application Ser. No. 372,826.

As compared with the known photoreceptive materials mentioned above, the photoreceptive material made of a-Si has the advantages represented by its excellent holdability of electric charge and sensitivity to light, as well as the ability of presenting clear images, in addition to the superior thermal strength, chemical stability and mechanical strength, and furthermore its harmlessness to human body and low manufacturing cost.

Such a-Si photoreceptor is obtained by forming, on top of a conductive substrate by relying on such method as plasma CVD technique, sputtering technique and evaporation-deposition technique. However, in case, for example, an a-Si film is formed by glow discharge using a high frequency in a gas atomosphere containing, for example, silane gas, the substrate requires to be held for a certain length of time at a temperature ranging from 200° to 300° C. The a-Si layer thus formed usually contains therein large distortions. In case, for example, the electroconductive substrate is a cylindrical drum, it will develop residual compressive stress therein, which can cause deformation or injury of the substrate per se.

Also, in case the a-Si photoreceptor thus formed is used to perform printing, the first step is to subject this photoreceptor to corona discharge under dark condition to charge this photoreceptor, and thereafter the image of an object such as a picture, a letter or a symbol which requires to be transferred is formed on this photoreceptor by an appropriately designed optical system. Since this photoreceptor has photoconductivity, the electric charges which this photoreceptor have been carrying in correspondence to the various levels of brightness of light coming from various portions of the object are discharged, and as a result, an electrostatic latent image of the object is formed on the photoreceptor. This electrostatic latent image is then caused to electrically attract the fine printing particles. And, these fine particles of the electrostatic latent image are deposited on a transfer sheet and are fixed thereon. Thus, a transfer of the image of the object is performed. During the course of formation of this electrostatic latent image, there takes place a migration of carriers between the a-Si layer and the electroconductive substrate. This migration greatly affects the characteristic of the photoreceptor due to, for example, the condition at the interface between the a-Si layer and the substrate or the type of material of the substrate.

Accordingly, it is needless to say that, for the substrate of an a-Si photoreceptor, there ought to be used such a material as will not deteriorate the characteristic of the photoreceptor, and besides, in view of the temperature condition required at the time of formation of the a-Si film, there cannot be employed a substrate having a low melting point. Furthermore, a substrate having such a low mechanical strength as will develop deformation due to interal stresses within the a-Si film is not desirable.

As discussed above, in the selection of the conductive substrate, it is required to use such a material as is superior in both thermal and mechanical strength, as well as satisfies the requirement of durability and the ability to sufficiently maintain the characteristic as a photoreceptor.

In spite of the fact that research and development of photoreseptors per se are presently making a progress in general, there has not been found or established a uniform view as yet with respect to the electroconductive substrate supporting such researches, especially with respect to the material of the substrate.

SUMMARY OF THE INVENTION

It is, therefore, the object of the present invention to provide an electroconductive substrate for an a-Si photoreceptor, which is capable of exhibiting a superior characteristic as a photoreceptor for electrophotography.

This object can be attained, according to the present invention, by adopting an aluminum alloy of aluminum-manganese group at the material of said substrate.

According to a desirable formation of the present invention, the manganese content of said aluminum alloy is in the range of 1.0–1.5% by weight.

Generally, the electrostatic characteristic of an a-Si photoreceptor closely associates with the quality of the image of electrophotograph, and the level of the electric potential due to charging greatly influences the contrasting of the image obtained. More specifically, in case the electric potential due to charging is low, the resulting image will be dominant in white color shade as a whole, which becomes a cause for poor quality of the image. The present inventors, after an extensive study with respect to substrate-constituting materials which are desirable for use in a-Si photoreceptors which are able to maintain, for example, superior electrostatic characteristic and quality of image, have confirmed that, by the use of an aluminum-manganese alloy as the material of the substrate, it is possible to remarkably enhance various characteristics of an a-Si photoreceptor.

The above and other objects of the present invention will become more apparent during the course of the following detailed description and appended claims.

DETAILED DESCRIPTION OF THE PREFERRED EMBODIMENT

Description will hereunder be directed to an embodiment of the Mn-based aluminum substrate according to the present invention, as compared with the conventional example using Mg-based aluminum as the material of the substrate.

An Al-Mg aluminum alloy has been exclusively employed in the past for the formation of electroconductive substrates of the abovesaid type for the reasons that it is superior in mechanical strength and resistance to corrosion as compared to pure aluminum.

The following table shows the comparative chemical compositions of Mn-based alminum and Mg-based aluminum.

TABLE

| Constituent | (Chemical composition: % by weight) | | | | | | | |
|---|---|---|---|---|---|---|---|---|
| element | Si | Fe | Cu | Mn | Mg | Cr | Sn | Al |
| Al—Mn (JIS 3003) | 0.6 | 0.7 | 0.05~ 0.20 | 1.0~ 1.5 | — | — | 0.1 | 96.9~ 97.55 |
| Al—Mg (JIS 5052) | 0.25 | 0.4 | 0.1 | 0.1 | 2.2~ 2.8 | 0.15~ 0.35 | 0.1 | 95.9~ 96.7 |

(Notes: JIS means Japanese Industrial Standards)

Mn-based aluminum is obtained by adding Mn in pure aluminum, thereby improving the mechanical strength while maintaining the ability of being easily processed and also the resistance to corrosion which are the features of pure aluminum. It has been found by the present inventors that, by directly applying Mn-based aluminum having the above-mentioned composition as the material of the substrate, there is formed a desirable a-Si photoreceptor as will be described later.

Here, as will be apparent from the above-mentioned table, it is desirable in applying the present invention that the Mn content of the Al-Mn alloy is in the range of 1.0–1.5% by weight. As stated above, the mechanical strength of the Al-Mn alloy increases by an addition of Mn. However, when the Mn content exceeds 1.5% by weight, the Mn in the alloy will come to present as a foreign substance in the surface of the alloy which is being processed, bringing about a lowering of the processability and also the property as alumite, and thus an alloy having such Mn content is not suited for a substrate. Also, an Mn content of 1.0% by weight or smaller results in a marked lowering of the mechanical strength, although the processability and corrosion resistance are improved. Accordingly, so far as the durability of the substrate against the compressive stress applied by the a-Si photoreceptor layer onto the substrate is concerned, or within the limits of the ability of the substrate to satisfy the reliability as a constituent part when incorporated in, for example, a copying machine or a printer and to improve the electrostatic characteristic of the photoreceptor, the proper Mn content is 1.0–1.5% by weight.

Figure 1:
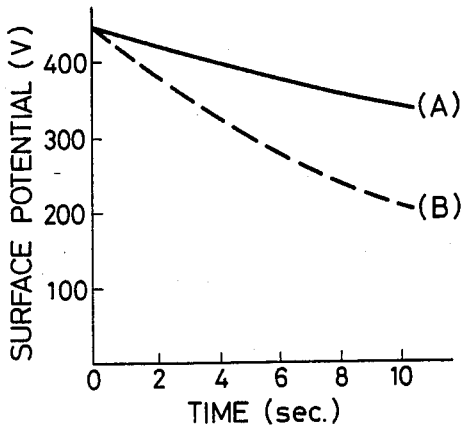
FIG. 1 is a chart showing the surface potential holding characteristic, in darkness, of the conventional photoreceptor for electrophotography using an Al-Mg substrate.
Figure 2:
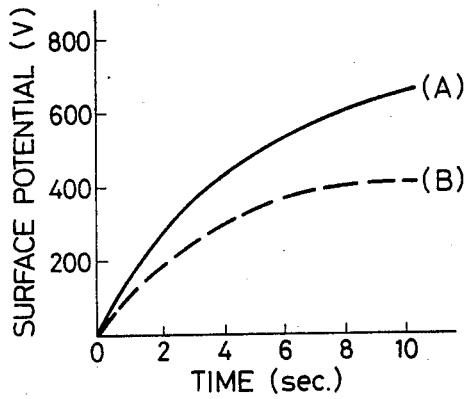
FIG. 2 is a chart showing the charge characteristic of the photoreceptor for electrophotography using an Al-Mn substrate according to the present invention.

Next, description will be directed to the comparison of the effect obtained from the photoreceptor of the present invention using Mn-based aluminum as the substrate and the effect derived from the photoreceptor using conventional Mg-based alminum as the substrate, by referring to FIGS. 1 and 2. In order to study the appropriateness of these materials for use in a substrate, two types of groups of a-Si photoreceptive layers having Al-Mn substrates and Al-Mg group, respectively, are formed, and a-Si photoreceptors of these two groups are manufactured.

FIG. 1 shows the manner of attenuation, in darkness, of the surface charge holding ability of these photoreceptors. Here, (A) indicates the attenuation in darkness of the a-Si photoreceptor using a substrate made of Mn-based aluminum which is adopted in the present invention, and (B) indicates the attenuation in darkness of the a-Si photoreceptor using a conventional substrate made of Mg-based aluminum. As will be apparent from this Figure, the initial potential holdability at the end of 10 seconds following a charging is noted to be as much as about 30% higher with the Al-Mn photoreceptors (A) as compared with the Al-Mg photoreceptors (B). Thus, it is noted that the photoreceptor using a substrate made of Al-Mn alloy (JIS 3003) exhibits a very good surface charge holding characteristic.

FIG. 2 is a chart showing the result of comparison of the respective charging speeds as measured of the above-mentioned respective groups of photoreceptors (A) and (B) under the conditions of a corona current of 70μA and a drum revolution of 120rpm. It is noted that the photoreceptor (A) using the Al-Mn substrate according to the present invention shows, at the end of 10 seconds after charging, a surface potential which is higher by 40% or more than in case of the photoreceptor (B).

Next, a comparative evaluation of the images obtained from these two groups of photoreceptors shows that the image obtained from the photoreceptor using the conventional Al-Mg substrate, under an identical copying process, exhibits poor contrast due to low black color shade. However, the image obtained from the photoreceptor of the present invention using an Al-Mn substrate shows an improved black color shade and contrast, and thus a very clear image is obtained.

What is claimed is:

1. An amorphous silicon photoreceptor for electrophotography, comprising: an electroconductive substrate made of an aluminum-manganese alloy, said alloy containing manganese in a range of 1.0–1.5% by weight, and a photoreceptive layer formed on said substrate and made mainly of amorphous silicon containing hydrogen.

2. An amorphous silicon photoreceptor for electrophotography, comprising:

an electroconductive substrate made of an aluminum-manganese alloy, said alloy containing manganese in a range of 1.0–1.5% by weight, and a photoreceptive layer made mainly of amorphous silicon containing hydrogen formed on said substrate by glow discharge using a high frequency in a gas atmosphere containing silane.

* * * * *